US009414986B2

(12) United States Patent
Scire

(10) Patent No.: US 9,414,986 B2
(45) Date of Patent: Aug. 16, 2016

(54) DEVICE AND METHOD FOR SIMULTANEOUSLY STRETCHING FINGERS AND HAND AND STRENGTHENING HAND AND FOREARM

(71) Applicant: Randy S. Scire, Succasunna, NJ (US)

(72) Inventor: Randy S. Scire, Succasunna, NJ (US)

( * ) Notice: Subject to any disclaimer, the term of this patent is extended or adjusted under 35 U.S.C. 154(b) by 146 days.

(21) Appl. No.: 13/904,001

(22) Filed: May 28, 2013

(65) Prior Publication Data

US 2013/0316877 A1 Nov. 28, 2013

Related U.S. Application Data

(60) Provisional application No. 61/652,181, filed on May 26, 2012.

(51) Int. Cl.

| | |
|---|---|
| ***A63B 23/16*** | (2006.01) |
| ***A61H 1/02*** | (2006.01) |
| ***A63B 21/00*** | (2006.01) |
| ***A63B 21/02*** | (2006.01) |
| ***A63B 21/05*** | (2006.01) |

(52) U.S. Cl.

CPC ..... *A61H 1/0285* (2013.01); *A61H 1/0288* (2013.01); *A63B 21/00* (2013.01); *A63B 21/028* (2013.01); *A63B 21/05* (2013.01); *A63B 21/4019* (2015.10); *A63B 21/4025* (2015.10); *A63B 21/4035* (2015.10); *A63B 21/4039* (2015.10); *A63B 23/16* (2013.01); *A61H 2201/0153* (2013.01); *A61H 2201/1261* (2013.01); *A61H 2201/168* (2013.01); *A61H 2201/1635* (2013.01)

(58) Field of Classification Search

CPC ..... A63B 21/02; A63B 21/028; A63B 21/05; A63B 21/143; A63B 21/1438; A63B 21/1449; A63B 21/1469; A63B 21/1476; A63B 23/10; A63B 23/16; A61H 2201/0153; A61H 2201/027; A61H 2201/1635

USPC ..... 482/44–50, 79, 121, 122, 124, 126, 482/128; 601/23, 27, 33, 40; 602/21

See application file for complete search history.

(56) References Cited

U.S. PATENT DOCUMENTS

| | | | | |
|---|---|---|---|---|
| 806,681 | A | 12/1905 | Kursheedt | |
| 886,591 | A | 5/1908 | Finger | |
| 2,271,164 | A | 1/1942 | Sullivan | |
| 3,129,939 | A | 4/1964 | Stock | |
| D226,736 | S * | 4/1973 | Benis | D28/61 |
| 4,730,827 | A * | 3/1988 | Williams | 482/47 |

(Continued)

*Primary Examiner* — Loan H Thanh
*Assistant Examiner* — Gregory Winter

(57) ABSTRACT

A hand stretching and strengthening device comprised of a unitary form and of resilient, compressible material. The device comprises a plurality of thick finger-stretch wedges extending from a connective base. Each wedge can include a depression on each of its sides to provide comfort and hold. The base provides the foundation for the wedges to extend from and provides resistance to strengthen the hand and forearm. The device holds its position on a user's hand, provides a constant stretching force between the fingers, and provides increased stretching force between fingers as the user closes the hand. The device is small, lightweight, portable, quietly operated and can be worn indefinitely without effort. The device provides an engaging exercise experience by allowing the user to simultaneously stretch and strengthen the fingers, hand, and forearm while executing a wide range of unrestricted motions including motions that mimic playing a musical instrument.

18 Claims, 10 Drawing Sheets

(56) References Cited

U.S. PATENT DOCUMENTS

| | | | | | |
|---|---|---|---|---|---|
| 4,961,568 | A | | 10/1990 | Clark et al. | |
| 4,977,621 | A | * | 12/1990 | Richard | 2/161.3 |
| 5,058,885 | A | * | 10/1991 | Brant | 482/48 |
| 5,062,625 | A | | 11/1991 | Vonk | |
| 5,076,569 | A | * | 12/1991 | Gootter | 482/49 |
| 5,136,911 | A | | 8/1992 | Wyss | |
| 5,147,256 | A | | 9/1992 | Silagy | |
| 5,374,226 | A | | 12/1994 | Grahm | |
| 5,453,064 | A | | 9/1995 | Williams, Jr. | |
| 5,527,244 | A | | 6/1996 | Waller et al. | |
| 5,716,303 | A | | 2/1998 | Scatterday | |
| 5,820,522 | A | | 10/1998 | Smallwood et al. | |
| D415,858 | S | * | 10/1999 | Funatogawa | D28/56 |
| 6,179,751 | B1 | | 1/2001 | Clears | |
| 6,228,001 | B1 | | 5/2001 | Johnson et al. | |
| 6,817,967 | B1 | | 11/2004 | Ott et al. | |
| 6,986,728 | B2 | | 1/2006 | Kasun | |
| 7,381,156 | B2 | | 6/2008 | Silagy | |
| 7,967,732 | B2 | | 6/2011 | D'Addario et al. | |
| 8,343,015 | B2 | | 1/2013 | Zachary | |
| 2002/0072455 | A1 | * | 6/2002 | Akins | 482/93 |
| 2006/0243291 | A1 | * | 11/2006 | Daley | 132/73 |
| 2008/0300112 | A1 | | 12/2008 | Crout | |
| 2009/0093345 | A1 | | 4/2009 | Findeisen | |
| 2009/0156361 | A1 | | 6/2009 | Ferri | |
| 2009/0156367 | A1 | * | 6/2009 | Harris et al. | 482/49 |
| 2011/0281688 | A1 | * | 11/2011 | Harris et al. | 482/44 |
| 2012/0279374 | A1 | | 11/2012 | Wohltan | |

* cited by examiner

DEVICE AND METHOD FOR SIMULTANEOUSLY STRETCHING FINGERS AND HAND AND STRENGTHENING HAND AND FOREARM

CROSS-REFERENCE TO RELATED APPLICATIONS

This application claims the benefit of provisional patent application Ser. No. 61/652,181, filed May 26, 2012 by the present inventor.

BACKGROUND

This invention relates to hand exercisers in general and more specifically to finger stretchers, and finger, hand, and forearm strengtheners for musicians. Increasing the reach, span, and dexterity of the fingers and improving the strength of the fingers, hand, and forearm is important for many individuals, especially for musicians and beginner musicians learning to play a musical instrument, such as a guitar or piano. Stretching the fingers and strengthening the fingers, hand, and forearm will enable the individual to execute hand movements more easily and will allow the musician and beginner musician to more effectively play an instrument such as guitar or piano. Increased finger span will also allow the musician and beginner musician to more easily make stretches required on a musical instrument such as guitar or piano.

Although the fingers, hand, and forearm can be conditioned and strengthened while playing the musical instrument, sometimes this can be a challenging and frustrating task, especially for the beginner musician that is not yet proficient on the instrument. Such an individual will often find more pleasure in mimicking the motions of playing the instrument, especially while listening to a favorite song. One example of this satisfying user activity is commonly referred to as "playing air guitar".

Additional opportunities to exercise the fingers and hand can often be missed: the musical instrument may not always be available to the musician; the sudden urge, inspiration, or inclination to exercise the fingers and hand may occur and pass quickly; or the musician may be located in an environment where the noise produced by a musical instrument may not be desired.

There is a need for a quietly operated, small, lightweight, and portable device that can be worn indefinitely on the hand without effort and will allow the user to simultaneously stretch the fingers and strengthen the fingers, hand, and forearm. Such a device should also provide an engaging and encouraging exercise experience that includes allowing the user to execute a wide range of unrestricted motions and movements that mimic the playing of a musical instrument such as guitar.

There are many known devices to stretch the fingers or strengthen the fingers, hand, and forearm. Known devices such as U.S. Pat. No. 806,681 (1905) to Kursheedt, U.S. Pat. No. 886,591 (1908) to Finger, and U.S. Pat. No. 5,374,226 (1994) to Grahm include a board or plane to place the hand upon in a flat position and provide adjustable flat solid wedges or adjustable pegs to stretch the fingers apart.

Other known devices such as U.S. Pat. No. 4,961,568 (1990) to Clark et al. and U.S. Pat. No. 5,136,911 (1992) to Wyss include rigid rings connected to an adjustable rigid or semi-flexible frame that can receive a plurality of fingers and allow the fingers to be stretched in a predetermined fixed positioned or stretched in a limited or restricted manner.

Other known devices such as U.S. Pat. No. 5,062,625 (1991) to Vonk, U.S. Pat. No. 6,179,751 (2001) to Clears, U.S. Pat. No. 6,817,967 (2004) to Ott et al., and U.S. Pat. No. 6,986,728 (2006) to Kasun include a form of elastic material to be placed on or around the fingers to exercise and strengthen the extension of fingers through elastic resistance.

Other known devices such as U.S. Pat. No. 2,271,164 (1942) to Sullivan, U.S. Pat. No. 3,129,939 (1964) to Stock, and U.S. Pat. No. 5,716,303 (1998) to Scatterday include a deformable frame or pliable material to strengthen the hand through the resistance provided by a compressing or deforming activity.

Other known devices such as U.S. Pat. No. 6,228,001 (2001) to Johnson et al. and U.S. Pat. No. 8,343,015 (2013) to Zachary include both elastic extension resistance and compressible resistance to strengthen and exercise the fingers and hand.

Other known devices such as U.S. Pat. No. 5,453,064 (1995) to Williams, Jr. and U.S. Pat. No. 5,527,244 (1996) to Waller et al. include a form of glove to provide resistance and strengthening exercise to the hand when worn.

There are other devices such as U.S. Pat. No. 5,147,256 (1992) to Silagy and U.S. Pat. No. 7,967,732 (2011) to D'Addario et al. that use spring mechanisms to exercise and strengthen each individual finger of the hand and can treat the tips of the fingers.

There are also other devices known that describe the use of finger spacers, wedges, protrusions, or extensions to stretch the fingers, or position the fingers, or to therapeutically treat the hand. U.S. Pat. No. 5,820,522 (1998) to Smallwood et al. describes and claims a therapeutic device with a plurality of thin flat extensions that can include an elastic band to strengthen the hand. U.S. patent application 2009/0156361 (2009) of Ferri describes individually operating flat wedge finger spacers and individual conical finger spacers. In another embodiment proposed by Ferri, the individual spacers can be connected by a handle that is used to pull the spacers between the fingers. Foreign patent document WO 2011000010 (2011) of Wohltan describes a single finger positioner to be placed parallel between two adjacent fingers to space them apart while playing the guitar and uses a transversal pin to hold the wedge in place without obstructing the playing of the instrument.

All of the known devices possess one or more of the following deficiencies:

a. They do not include independent and distally open-spaced wedges to stretch the fingers apart with a substantial and continuous stretching force and do not include a connective base providing resistance in the palm of the hand to simultaneously strengthen the fingers, hand and forearm during use. These devices do not provide an increasing stretching force applied comfortably over the finger joint areas between the fingers as the user closes the hand.

b. They are bulky and constructed of rigid materials. These devices are heavy or cumbersome and cannot be worn or easily transported with the user for quick, convenient access and mobile use.

c. They employ a specific hand, wrist or arm position to operate and substantially inhibit the free movement of the hand, wrist or arm during use. These devices do not allow for a generous range of substantially unrestricted motion for fingers, hand, wrist and arm during use.

d. They do not securely hold their placed position on the hand without continued active effort on the part of the user. These devices do not allow for the user to wear the device indefinitely or to dynamically change hand, wrist and arm positions during use or execute natural and exaggerated finger, hand and arm movements including motions that mimic the playing of a musical instrument without losing the placement of the device on the hand.

e. They contain hard mechanical moving parts composed of plastic and metal, including springs that may produce an undesirable amount of noise during use.

SUMMARY

In accordance with one embodiment an improved finger, hand and forearm exercise and conditioning device to provide substantial and continuous stretching force applied comfortably over the finger joint areas between the fingers, to simultaneously stretch the fingers and hand and to strengthen the hand and forearm, and to securely hold itself as positioned on the hand includes a single unitary form of lightweight, resilient, compressible material such as non-irritant foam, rubber, gel or other similar material that can be quietly compressed and returns to its original shape after compression. The device includes three thick variable-width, contoured, finger-stretch wedges that include a width and height and extend in length outward from a connective base. The wedges have open spaces at their distal end and between each adjacent wedge. The device is positioned on the hand of the user, wherein the connective base is placed in the upper palm and each finger-stretch wedge is positioned through the space existing between two adjacent fingers on the hand so the length of each wedge extends in a direction that is generally perpendicular with respect to the length of the fingers from base knuckle to fingertip. When positioned as described, each wedge has a sufficient width, height and length to substantially cover and form around the finger joint areas between the fingers and the wedges also have a sufficient length to extend beyond and form around the dorsal surface of the fingers thus holding the device securely on the user's hand indefinite and without user effort, providing a substantial and continuous stretching force between the user's fingers, and providing increased stretching force as the fingers are curled or folded inwards towards the palm as in the motion of closing the hand. The device further includes the connective base that is placed in the upper palm of the user's hand. The connective base has sufficient size and shape providing a foundation for the finger-stretch wedges to extend from, assists in holding the position of the device on the hand and provides compressive resistance to the fingers, hand, and forearm when the fingers are curled or folded inwards towards the palm as in the motion of closing the hand.

Accordingly, one or more embodiments provide several advantages as follows: a resilient and compressible device of single unitary form that is operated quietly and is sufficiently small, lightweight, and portable to be easily carried in the pocket of the user for convenient and frequent access and use; that is placed easily in position on the user's hand and holds its position on the hand indefinitely without user effort thus allowing for immediate, convenient and frequent use of the device; that provides substantial and continuous stretching forces applied comfortably over the finger joint areas between the fingers and allows the user to simultaneously stretch the fingers and hand and strengthen the fingers, hand, and forearm; that allows for increased resistance and stretching force to the fingers and ligaments of the hand as the user folds or curls the fingers inward towards the palm, as in the motion of closing the hand into a fist, and allows for decreased resistance and stretching force to the fingers and ligaments of the hand as the user unfolds or straightens the fingers outwards from the palm, as in the motion of opening the hand; that allows for a generous range of natural and exaggerated, substantially unrestricted, user controlled motions of the fingers, hand, wrist, and arm during use; these motions including those that mimic the playing of a musical instrument such as guitar; and the device securely holding its placement on the hand throughout execution of such motions, thus creating an engaging, fun and effective exercise experience for the user. Other advantages of one or more embodiments will be apparent from a consideration of the drawings and ensuing description.

DRAWINGS

REFERENCE NUMERALS

10 Device
12 Connective Base
14 Finger-Stretch Wedges
16 Finger Joint Depressions
22 Base Ledge
24 Finger Tip Target Area
26 Thumb Depressions
28 Flexible Material Skin

DETAILED DESCRIPTION

—FIGS. 1-6 AND 16-17

First Embodiment

Figure 1:
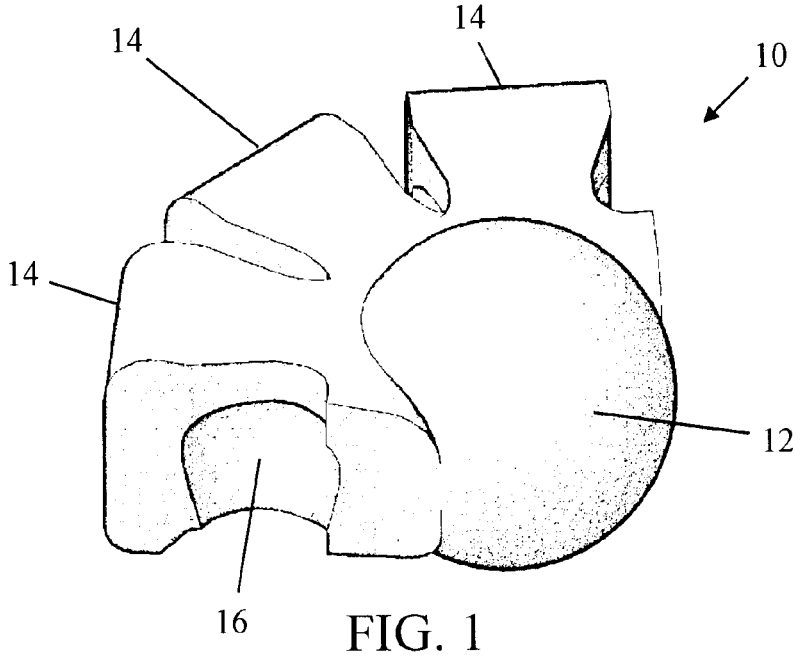
FIG. 1 is a perspective top view of one embodiment of the device with a generally spherical connective base.
Figure 2:
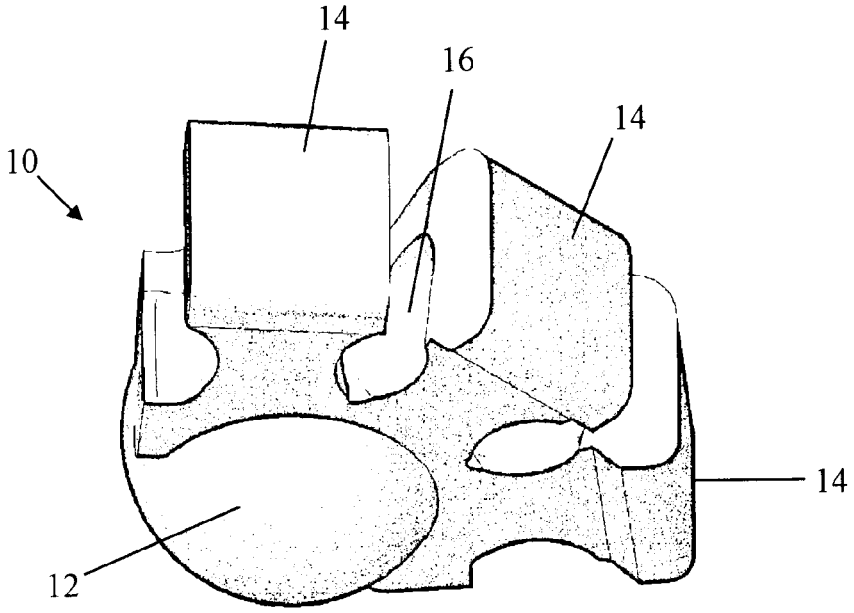
FIG. 2 is a perspective bottom view of one embodiment of the device with a generally spherical connective base.
Figure 3:
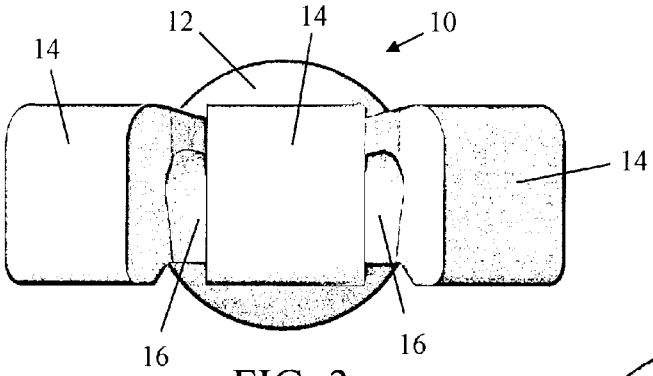
FIG. 3 is an orthogonal front view of one embodiment of the device with a generally spherical connective base.
Figure 4:
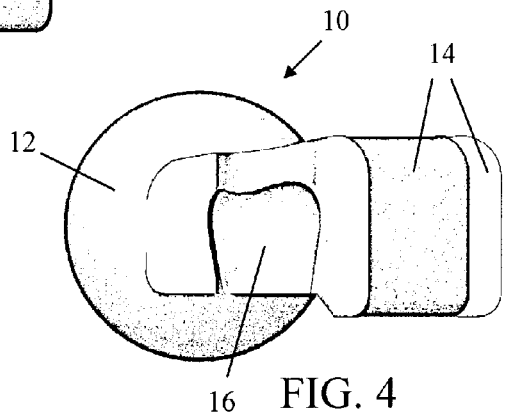
FIG. 4 is an orthogonal side view of one embodiment of the device with a generally spherical connective base.
Figure 5:
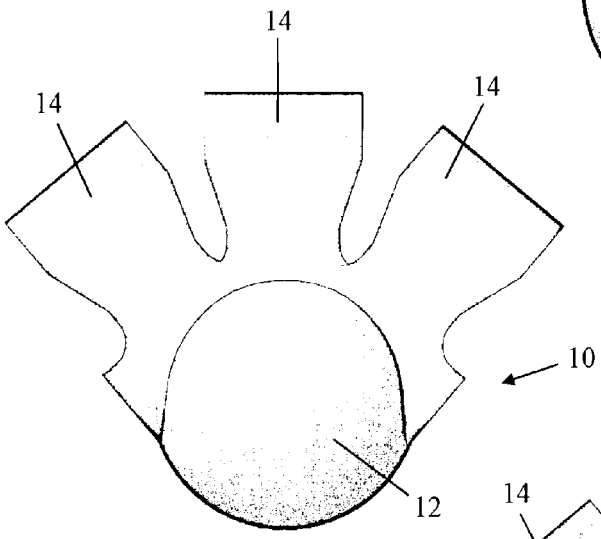
FIG. 5 is an orthogonal top view of one embodiment of the device with a generally spherical connective base.
Figure 6:
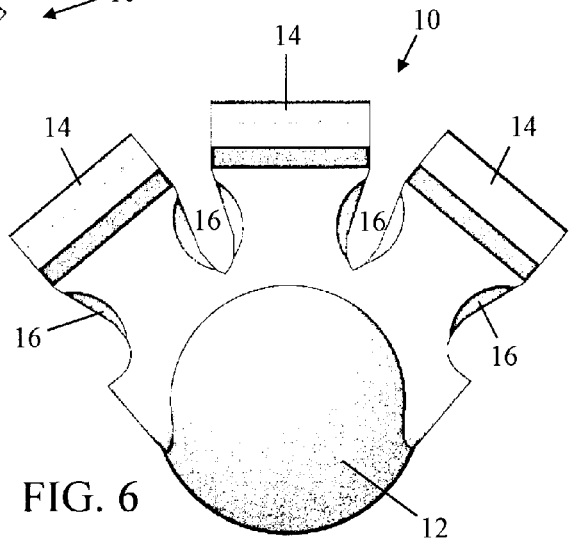
FIG. 6 is an orthogonal bottom view of one embodiment of the device with a generally spherical connective base.
Figure 16:
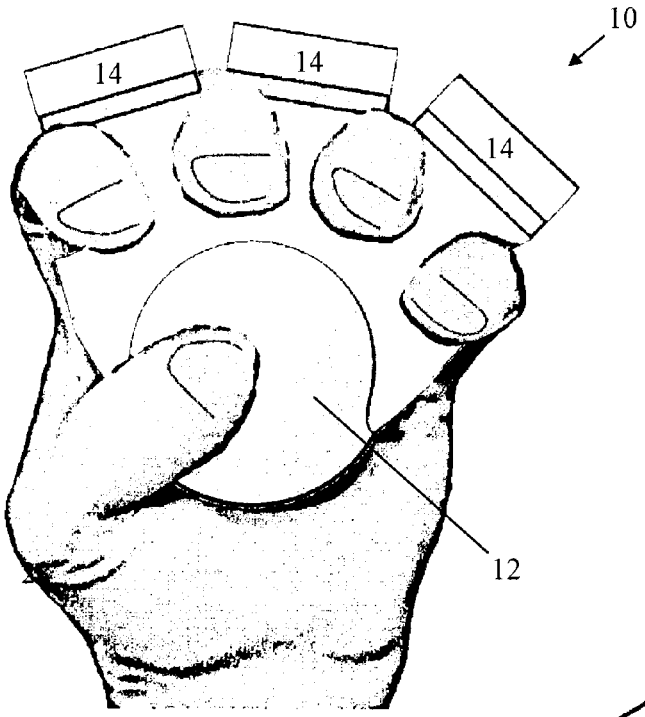
FIG. 16 is a bottom view of the method of use of one embodiment of the device showing the device positioned in the hand.
Figure 17:
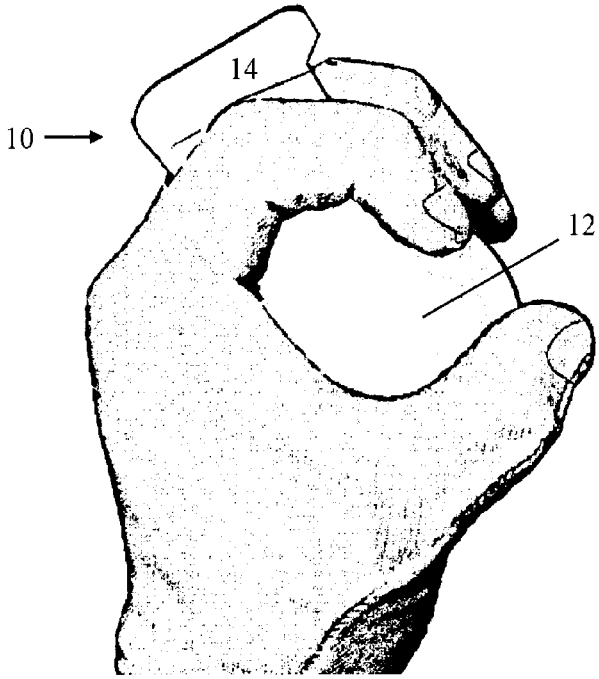
FIG. 17 is a side view of the method of use of one embodiment of the device showing the device positioned in the hand.
Figure 18:
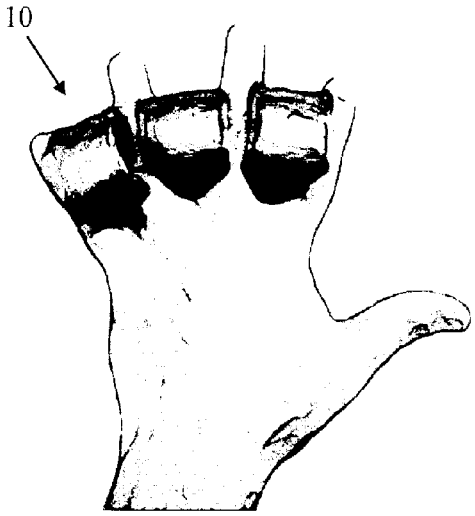
FIG. 18 is a view of the method of use of one embodiment of the device showing the hand in the open position.
Figure 19:
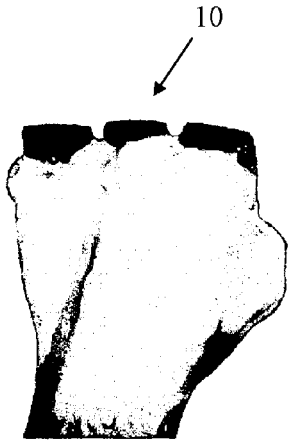
FIG. 19 is a view of the method of use of one embodiment of the device showing the hand in the closed position.
Figure 20:
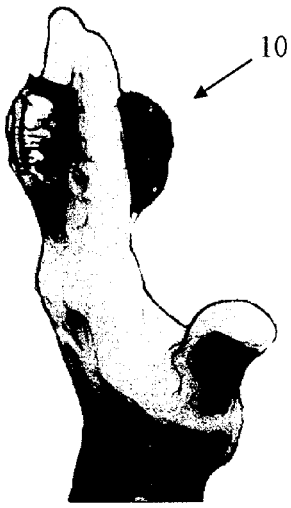
FIG. 20 is a side view of the method of use of one embodiment of the device showing the hand in the open position.
Figure 21:
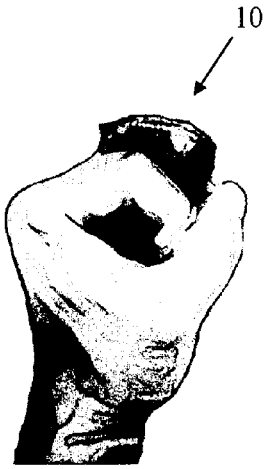
FIG. 21 is a side view of the method of use of one embodiment of the device showing the hand in the closed position.

One embodiment of an improved finger, hand, and forearm exercise device 10 to simultaneously stretch the fingers and strengthen the hand and forearm, and securely hold its position on the hand is illustrated in FIG. 1 (perspective top view), FIG. 2 (perspective bottom view), FIG. 3 (orthogonal front view), FIG. 4 (orthogonal side view), FIG. 5 (orthogonal top view) and FIG. 6 (orthogonal bottom view). The exercise device 10 includes a single unitary form of resilient, compressible material such as non-irritant foam, rubber, gel or other similar material that can be quietly compressed and returns to its original shape after compression. The exercise device 10 is sufficiently small, lightweight, and portable to be easily carried in the pocket of the user for convenient and frequent access and use. It is the intention that the exercise device 10 is to be placed and worn on the hand between the fingers and in the upper palm area of the hand, as shown in FIGS. 16 and 17.

One embodiment of the exercise device 10 further includes three substantially thick, compressible, variable-width, contoured, finger-stretch wedges 14 similarly oriented and spaced apart in line extending independently and generally radially from a compressible connective base 12. Each wedge 14 includes a length as measured along a line produced as each wedge 14 extends outward in a generally radial direction from the base 12; a width as measured along a first line or curve on a plane, the first line or curve running through the wedges 14 and generally parallel to a second line or curve on the same plane, the second line or curve produced by connecting the center points of each wedge 14 where each wedge 14 contacts and connects with the surface of the base 12; and a height of each wedge 14 as measured along a line that is perpendicular to both the length line and width line. The wedges 14 have open spaces at their distal end and between each adjacent wedge 14 and are intended to be positioned so the length of each wedge 14 extends in a direction that is generally perpendicular with respect to the length of the fingers from base knuckle to fingertip and each wedge 14 positioned through the space existing between two adjacent fingers on a user's hand. It is intended that the three wedges 14 will be placed in the three spaces that exist between the four adjacent fingers of the hand. The wedges 14 have a sufficient width, height and length holding the exercise device 10 on the user's hand indefinitely without user effort, providing substantial and continuous stretching forces applied comfortably over the finger joint areas between the user's fingers, and providing increased stretching force as the fingers are curled or folded inwards towards the palm by the user as in the motion of forming a fist. The wedges 14 measure approximately 3-6 cm in length from the point where each wedge 14 extends from the base 12 and measure approximately 2-5 cm wide of varying width across the extended length of the wedge 14, becoming wider as the wedge 14 extends further from the base 12. The wedges 14 are attached to the base 12 and extend from the base 12 in this embodiment at an angle approximately 20 to 35 degrees with respect to the adjacent wedges 14. The adjacent wedges 14 are spaced approximately 2 to 5 cm apart from their respective extension length centerlines from where each wedge 14 is connected to the base 12. The wedges 14 can include contoured finger joint depressions 16, as shown in FIGS. 1, 2, 3, 4, 6 (and other related figures), that are located on the sides of the wedges 14 where they make contact with the fingers and are approximately 2-5 cm in diameter and approximately 0.2-1 cm deep. The finger joint depressions 16 are sufficiently shaped and sized to accommodate the natural form of the finger and comfortably aid in holding the placed position of the exercise device 10 on the hand.

In this embodiment, the base 12 is of a generally spherical shape, approximately 4-7 cm in diameter, and is intended to be placed in the upper palm of the user's hand. The base 12 has a sufficient size and shape providing a foundation for the wedges 14 to extend from, and holding the position of the exercise device 10 on the hand in conjunction with the finger-stretch wedges 14, and providing compressive resistance to the fingers and hand when the fingers are curled or folded inwards towards the palm as in the motion of forming a fist.

Operation—FIGS. 16-21

One embodiment of the device 10 is produced as a single unitary form including compressible lightweight material and is small enough to be placed in the user's pocket and is easily transported and carried with the user for fast and convenient access. The device 10 does not generate a significant amount of noise when operated, allowing for discreet operation in quiet environments.

As shown in FIGS. 16-17, one embodiment of the exercise device 10 is placed in the hand with the connective base 12 in the upper palm area, and each finger-stretch wedge 14 positioned so the length of each wedge 14 extends in a direction that is generally perpendicular with respect to the length of the fingers from base knuckle to fingertip and each wedge 14 positioned through the space existing between two adjacent fingers on the hand, and the finger joint depressions 16 placed comfortably in a predetermined position along the fingers. Whereby, the wedges 14 hold the device 10 on the user's hand and provide a substantial and continuous (and potentially increasing) stretching force between fingers. The base 12 holds the position of the device 10 on the hand, and provides compressive resistance to the fingers and hand when compressed. The finger joint depressions 16 provide additional comfort and hold against the fingers.

As shown in FIGS. 18-21, the user curls or folds the fingers repeatedly inward towards the palm as to form a fist. The user can also hold a closed or semi-closed hand position if desired. The shaped finger joint depressions 16 add comfort during use and help secure the position of the device 10 on the hand. When the device 10 is placed on the hand as previously described and the fingers and hand are opened and closed as described, the compressible wedges 14 will provide variable resistance between the fingers, stretching the fingers and ligaments of the hand apart. This stretching force can be controlled by the user and will increase as the fingers are curled or folded closer to the palm and decrease as the fingers are curled or folded away from the palm.

The device 10 securely holds its position on the hand indefinitely without user effort and allows a wide range of substantially unrestricted motions of the hand, wrist and arm during use without falling off. The user may choose to listen to music while operating the device 10 and mimic instrument playing motions. The user is free to dynamically express natural and exaggerated motions of the arm, wrist and hand as desired. Creative and engaging motions can be executed without the device 10 falling off the hand. This produces a fun and effective hand exercise experience for the user which further encourages continued use of the device 10 and continued benefits.

The device 10 will improve the strength and physical condition of the hand and forearm. Over time, the finger span of the user will be increased and the dexterity of the hand improved as a result of using the device. Musicians, including but not limited to guitar and keyboard players, will benefit from using the device 10 to stretch and strengthen their playing hand because increasing the finger span, dexterity and strength will allow easier access to strings across fret distances on the neck of a guitar or keys across a piano when playing chords and melodies.

The device 10 may also have benefits to other users seeking general finger stretching and finger, hand and forearm strengthening, such as users interested in general hand conditioning and users seeking a stress relief device.

Alternative Embodiments

Figure 7:
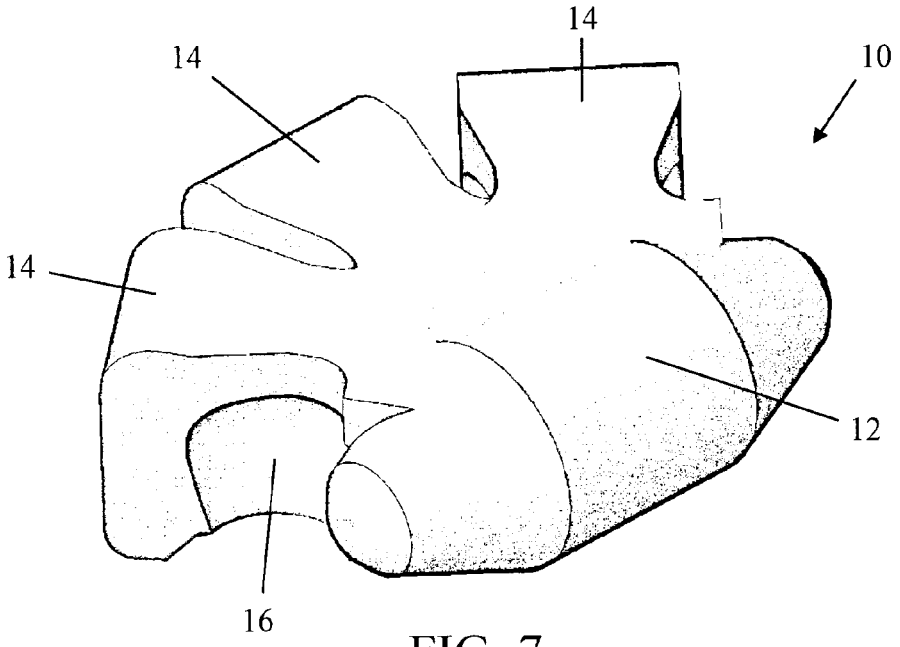
FIG. 7 is a perspective top view of another embodiment of the device with a generally semi-cylindrical connective base.
Figure 8:
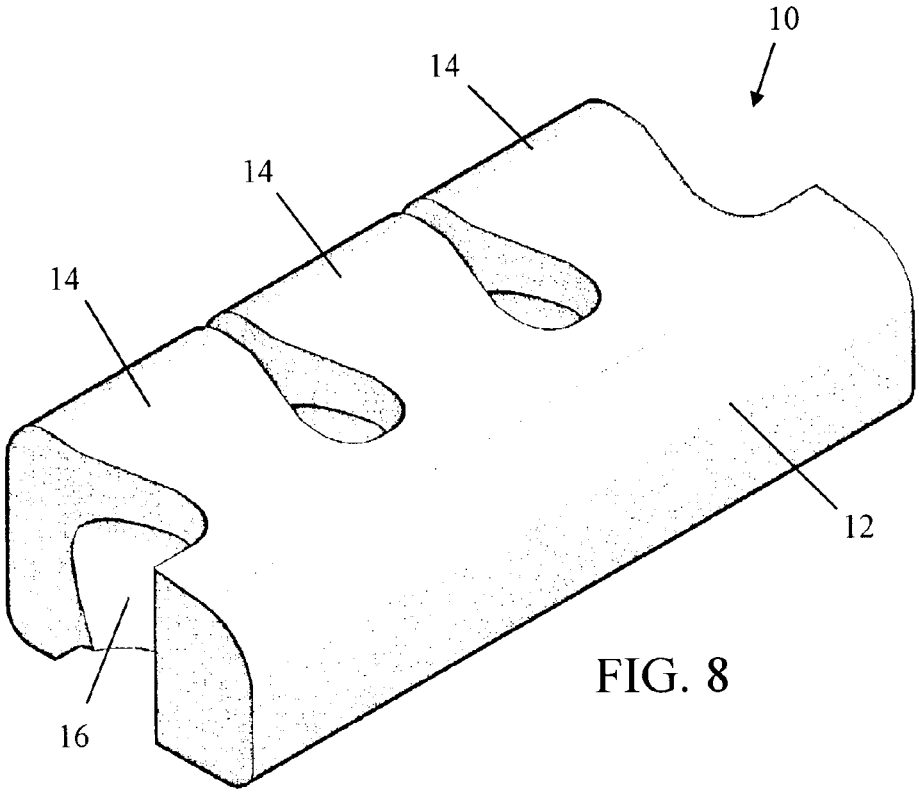
FIG. 8 is a perspective top view of another embodiment of the device with a generally straight and contoured elongated-block connective base.
Figure 9:
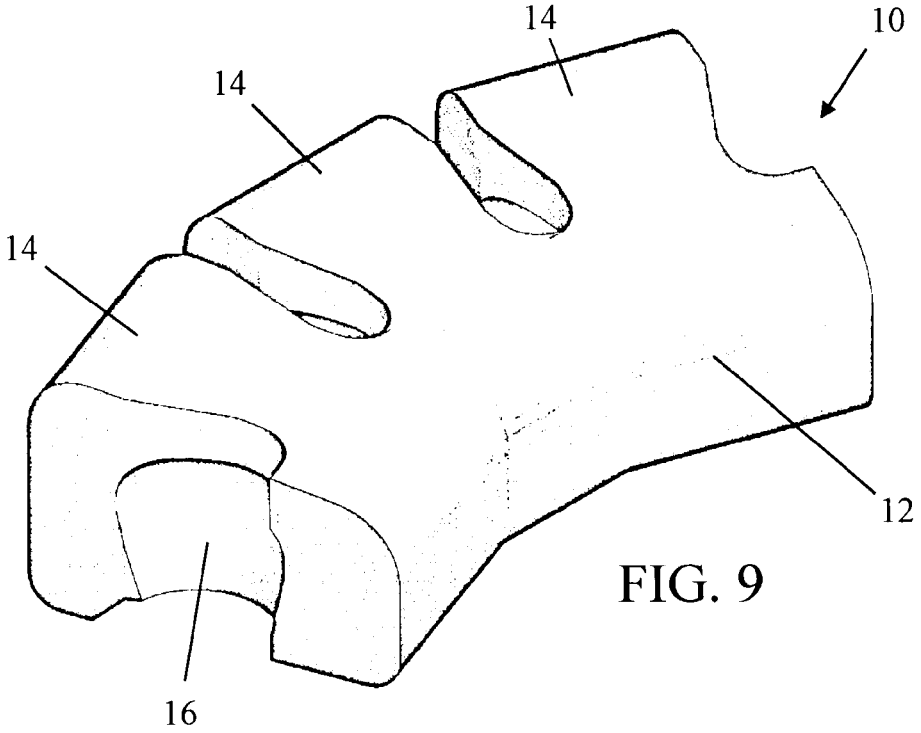
FIG. 9 is a perspective top view of another embodiment of the device with a generally curved and contoured elongated-block connective base.

The connective base 12 can be embodied in various shapes, including but not limited to, generally spherical (FIGS. 1-6, 10, 15, 16, 17 and 22); generally cylindrical, generally semi-cylindrical (FIG. 7); straight contoured elongated-block (FIGS. 8, 11, 12, 13, 14, 24 and 25), and curved contoured elongated-block (FIGS. 9 and 23) and can be 5-15 cm wide to accommodate the connections of the finger-stretch wedges 14.

Figure 10:
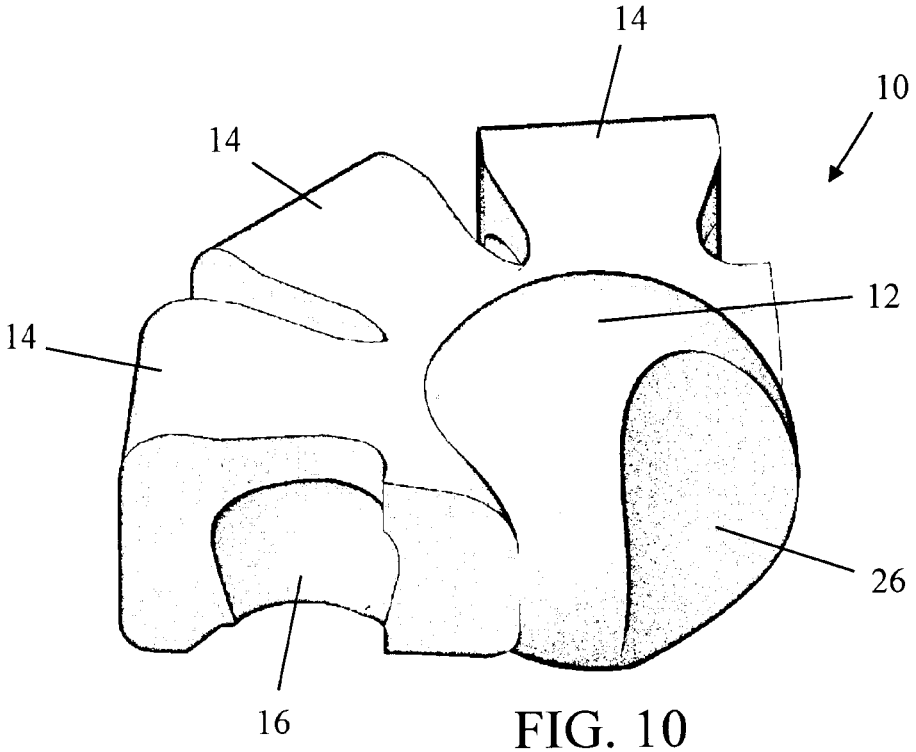
FIG. 10 is a perspective top view of another embodiment of the device with a generally spherical connective base and a thumb depression located on back side of the base.
Figure 11:
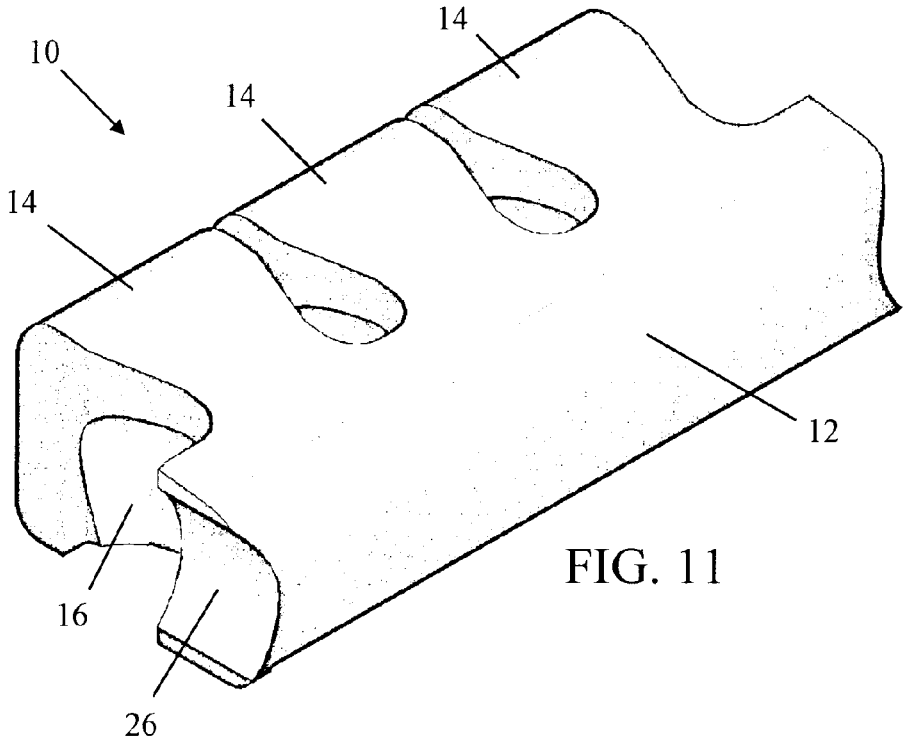
FIG. 11 is a perspective top view of another embodiment of the device with a generally straight and contoured elongated-block connective base featuring a thumb depression located on each side of the base.

In alternative embodiments, one or more thumb depressions 26 are 2-4 cm wide and can be included as part of the connective base 12. In one embodiment, a single thumb depression 26 is located on the back side of the base 12 as shown in FIG. 10 and in other embodiments as shown in FIGS. 11, 12, 13 and 14, a thumb depression 26 is located on each side of the base 12 where the thumb of the right-handed or left-handed user can be received and strengthened.

Figure 23:
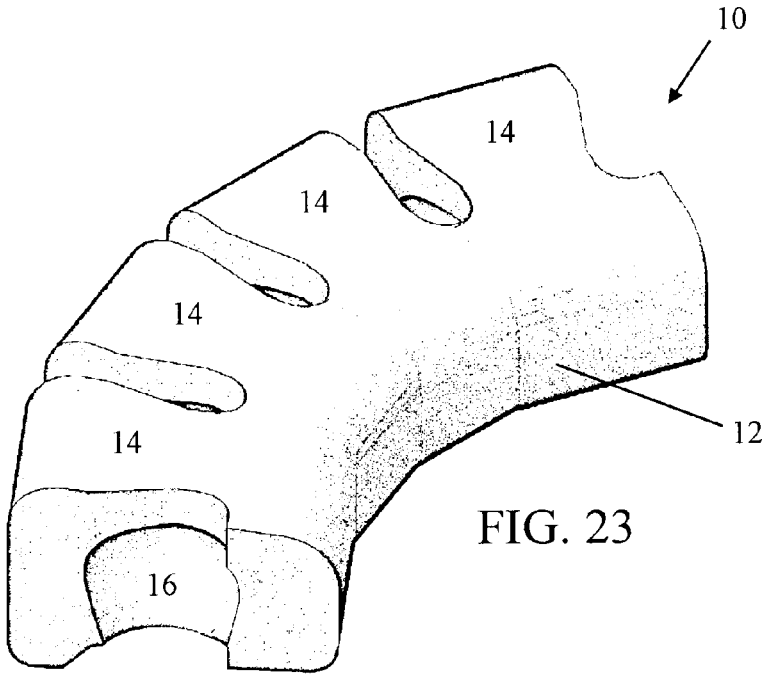
FIG. 23 is a perspective top view of another embodiment of the device with a generally curved and contoured elongated-block connective base and four finger-stretch wedges.

In another embodiment of the device as shown in FIG. 23, an additional fourth finger-stretch wedge 14 is available for placement between the index finger and the thumb. In alternative embodiment shown in FIG. 23, an additional finger-stretch wedge 14 can be added for placement between the index finger and the thumb to provide targeted exercise and resistance for the thumb and related muscles.

Figure 22:
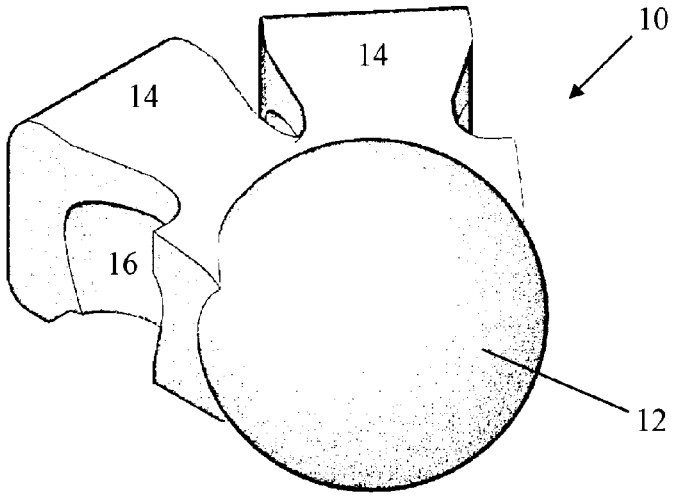
FIG. 22 is a perspective top view of another embodiment of the device with a generally spherical connective base and two finger-stretch wedges.

In another embodiment of the device as shown in FIG. 22, two finger-stretch wedges 14 are provided for placement between three adjacent fingers chosen by the user.

Figure 12:
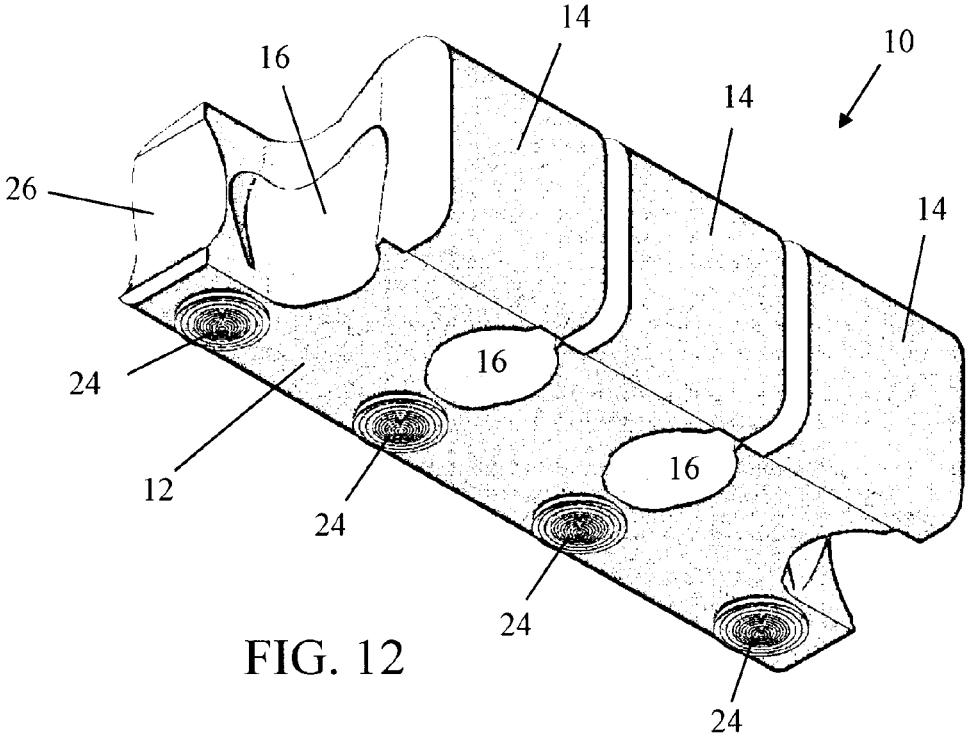
FIG. 12 is a perspective bottom view of another embodiment of the device with multiple separated finger tip target areas located on the connective base.
Figure 13:
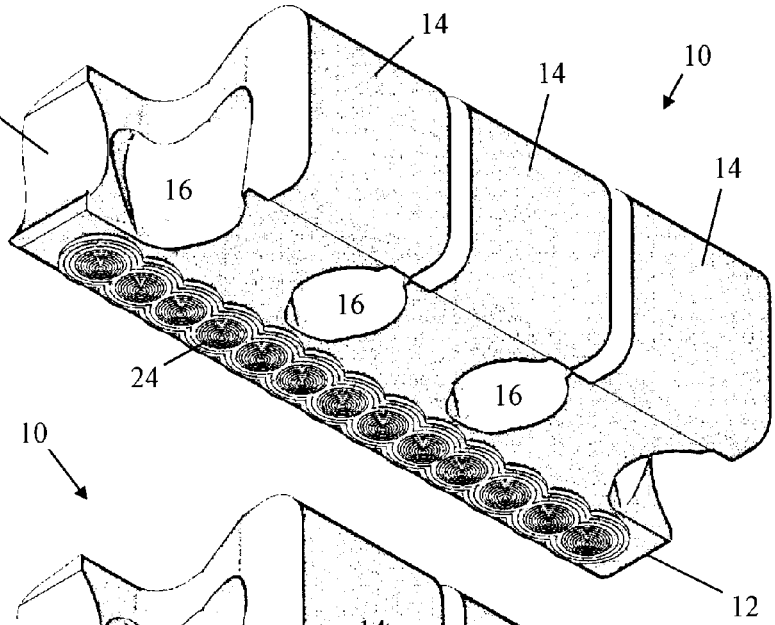
FIG. 13 is a perspective bottom view of another embodiment of the device with a finger tip target area strip running along the bottom length of the connective base.
Figure 14:
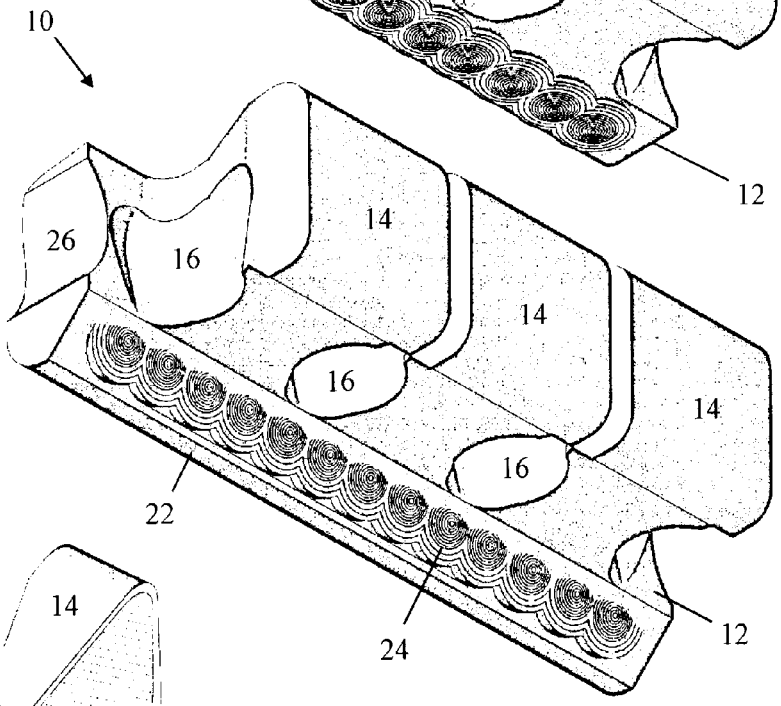
FIG. 14 is a perspective bottom view of another device embodiment including a base ledge extended from the connective base and a finger tip target area strip running along the length of the base ledge.

In alternative embodiments shown in FIGS. 12, 13 and 14, finger tip target areas 24 are embedded or exposed on the surface of the connective base 12 or on the surface of an extended base ledge 22 covering an area where the finger tips will make contact with the device during use. The target areas 24 add the ability to toughen the finger tips during operation of the device.

In alternative embodiments, finger tip target areas 24 are located where the finger tips will naturally make contact with the device 10. The target areas 24 are exposed on the surface of the connective base 12 as shown in FIGS. 12 and 13 or can be located on the surface of a base ledge 22 extending from the base 12 as shown in FIG. 14. The target areas 24 can be separate, for each finger tip as shown in FIG. 12, or can be one larger finger tip target area 24 running along the length of the base 12 as shown in FIG. 13 or the base ledge 22 as shown in FIG. 14.

Figure 24:
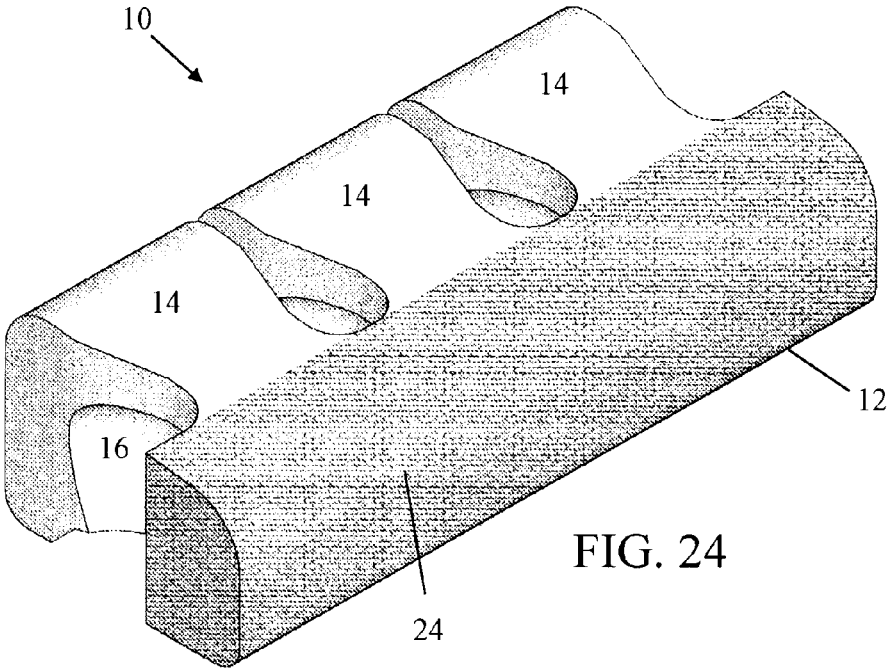
FIG. 24 is a perspective top view of one embodiment of the device with substantially the entire connective base surface covered with a tough finger tip target area material.
Figure 25:
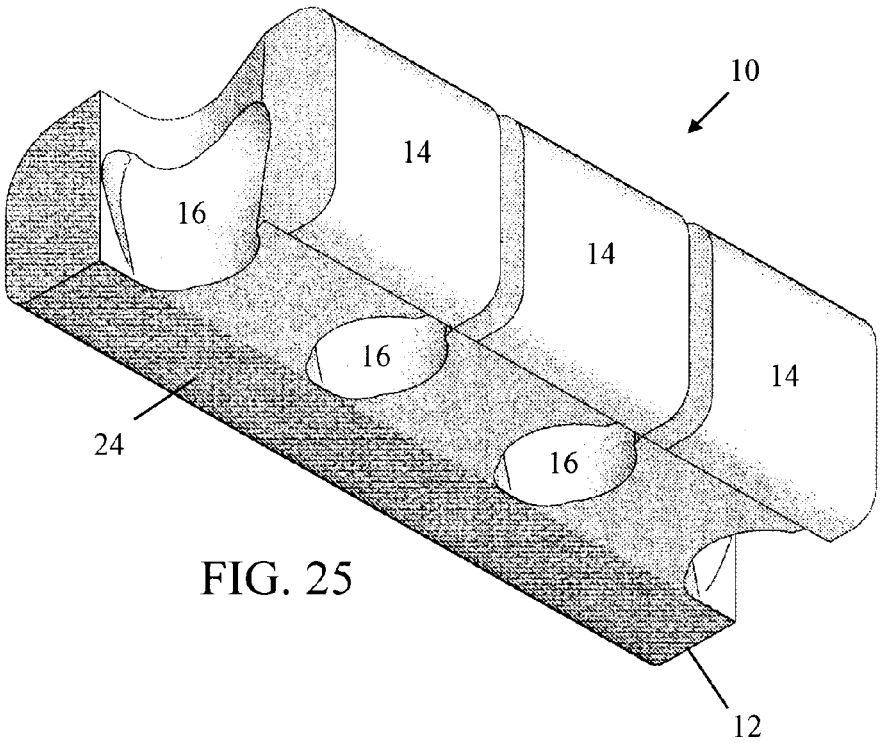
FIG. 25 is a perspective bottom view of one embodiment of the device with substantially the entire connective base surface covered with a tough finger tip target area material.

In another embodiment, as shown in FIGS. 24 and 25, the finger tip target area 24 is added to the top side of the connective base 12 or the entire surface of the connective base 12.

Figure 15:
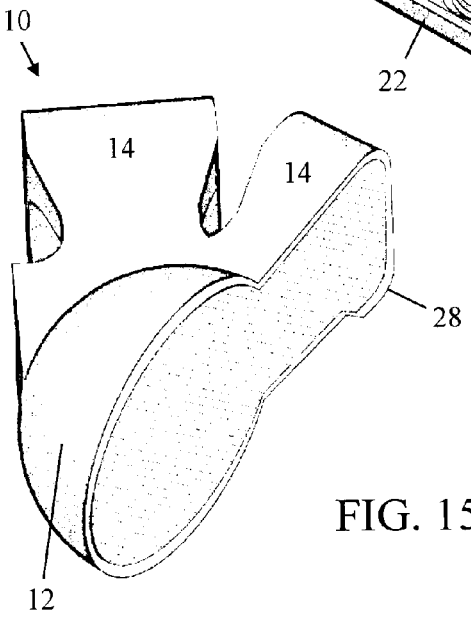
FIG. 15 is a perspective top view cross section of another device embodiment with a generally spherical connective base and a thin flexible material skin covering the outside surface of the device.

In an alternative embodiment as shown in FIG. 15, the entire surface of the device 10 can be covered with a flexible material skin 28 that can provide an alternative or improved look and textural feel to the device 10.

Advantages

Accordingly, from the description above, it becomes evident that a number of advantages are provided by one or more embodiments of an improved finger, hand and forearm exercise device:

a. A resilient and compressible exercise device of single unitary form that is sufficiently small, lightweight, and portable that can be easily be carried and transported with the user, for example in the pocket, for convenient and frequent access and use of the exercise device;

b. An exercise device that does not produce excessive noise that can be quietly operated discreetly by the user in many environments where a low level of noise is desired.

c. An exercise device that is easily worn by the user and holds its position on the hand indefinitely without continued effort allowing for immediate, spontaneous, convenient and frequent use of the exercise device;

d. An exercise device that provides substantial and continuous stretching forces applied comfortably over the finger joint areas between the fingers and allows the user to simultaneously stretch the fingers and hand and strengthen the fingers, hand and forearm at the same time;

e. An exercise device that allows user to control the amount and intensity of stretching force to the fingers and ligaments of the hand and strengthening resistance to the fingers, hand and forearm by folding or curling the fingers inward towards the palm as in the motion of forming a first and unfolding or straightening the fingers outwards from the palm as in the motion of opening a fist;

f. An exercise device that allows for a generous range of natural and exaggerated, substantially unrestricted, user controlled motions of the fingers, hand, wrist and arm during use, including motions that mimic the playing of a musical instrument such as guitar, and such an exercise device that securely holds its placement on the hand throughout such motions, creates an engaging, fun and effective exercise experience for the user.

CONCLUSIONS, RAMIFICATIONS, AND SCOPE

Accordingly, the reader will see that a quietly operated, small, lightweight, and portable device that securely holds its position on the hand and can be worn indefinitely on the hand without ongoing effort of the user will conveniently encourage immediate and more frequent exercising and conditioning of the fingers, hand and forearm. Such a device will allow exercising and conditioning of the fingers, hand and forearm in many situations and environments both at home and on the go and will make stretching the fingers and hand and strengthening the fingers, hand and forearm more spontaneous, addictive and fun. Additionally, a device that provides substantial and continuous stretching forces applied comfortably over the finger joint areas between the fingers and allows for the simultaneous stretching of the fingers and strengthening of the fingers, hand, and forearm addresses these exercising and conditioning needs of the musician that wishes to improve the ability to play an instrument such as guitar or piano. Furthermore an exercise and conditioning device that allows the user to control the amount of stretch and resistance while executing a wide range of substantially unrestricted motions including natural and exaggerated motions that mimic the playing of a musical instrument such as "playing air guitar" provides an engaging, effective and fun experience especially for the beginner musician that may become frustrated by the need to stretch the fingers and hand, and strengthen the fingers, hand and forearm.

Although the description above contains many specificities, these should not be construed as limiting the scope of the embodiments but merely providing illustrations of some of the several embodiments. For example, the connective base can have other sizes and shapes such as, generally cylindrical, semi-cylindrical, tapered-cylindrical, contoured block, multi-bend elongated-block, curved cylindrical, etc.; the base can provide a ledge which can be contoured and shaped smoothly, etc., the finger-stretch wedges can be positioned at less or more of an angle to accommodate the shape of the base or provide varied application of forces to the fingers; the finger joint depressions can be limited in number or limited to one or more wedges only; the base could be inverted during use to vary the stretch and resistance on the hand; the individual finger tip target areas can be of other shapes such as square, triangular, etc.; musicians that play other instruments such as brass instruments may also benefit from using the exercise device; the device without finger joint depressions may also be considered; the size of the exercise device can also be varied to accommodate users with larger or smaller hands; the material comprising the exercise device can be produced in varying degrees of firmness to offer increased or decreased resistance versions for different users; the finger tip target area can be produced of a harder, tougher or textured material that can be embedded or attached to the connective base or base ledge with an adhesive or other appropriate bonding or manufacturing means; the skin or surface can be colored, printed on or embossed by an appropriate means to display an identifier as to the properties of the exercise device or to feature an artistic, personalized or custom design.

Thus the scope of the embodiments should be determined by the appended claims and their legal equivalents, rather than by the examples given.

I claim:

1. A finger, hand, and forearm exercise device to simultaneously stretch fingers and strengthen a hand and forearm of a user, and securely hold its position on the hand, the device comprising:

a connective base formed of resilient, compressible material having sufficient size to fit in an upper palm of the user's hand and provide resistance to the hand and forearm when the hand is closed compressing the device, and having sufficient size to provide a foundation for a plurality of finger-stretch wedges to extend from;

a plurality of finger-stretch wedges formed of the resilient, compressible material having similar orientation and extending in a generally radial direction outward from the base to allow each of the wedges to be positioned between two adjacent fingers of the user's hand when said base is positioned in the upper palm of the user's hand, and said wedges when positioned as such having sufficient length, width, and height to substantially cover and hold the finger joints of the adjacent fingers providing substantial contact surface area to spread resistive forces across, and having sufficient width to provide substantial and continuous stretching forces between the adjacent fingers and to provide increasing stretching forces between the adjacent fingers as the hand is closed by the user, and having sufficient length to extend beyond a dorsal surface of the adjacent fingers, wherein each of said wedges includes a distal end relative to the base and said wedges increase in width toward the distal end to form substantially around the dorsal surface of the adjacent fingers, providing substantial hold and stability of the device on the hand during rapid and dynamic hand motions;

wherein the wedges extend independently from the base and there are open spaces between the distal ends of adjacent wedges to allow each of the wedges to be manipulated independently from each other providing more flexible and improved stretching capabilities and convenient access to receive and remove the fingers of the user and allowing the device to be positioned more easily on the user's hand;

wherein each of said wedges includes a finger joint depression on one or more wedge sides, wherein said depression can make contact with one of the fingers of the user when the device is positioned on the hand, said depression is sufficiently shaped, sized and positioned to comfortably accommodate the finger and to hold the placed position of the device on the hand;

wherein the resilient, compressible material can be deformed and will return to its original shape after compression, and whereby the device can be quietly operated and is small, lightweight, and portable, and whereby the size, shape and configuration of the wedges and the base allow the device to provide strengthening resistance to the fingers, hand, and forearm and provide substantial and continuous stretching forces applied comfortably to the finger joint areas between the fingers, and allow for simultaneous stretching of the fingers apart and strengthening of the hand and forearm as the device is compressed and decompressed by the action of closing and opening the hand, and also allow for the device to remain securely positioned on the hand without continued user effort, thus allowing enabling the user to wear the device indefinitely, and to dynamically change hand, wrist, and arm positions, and to execute both natural and exaggerated finger, hand, and arm motions without losing placement of the device on the hand.

2. The device of claim 1, wherein each of the wedges extends from the base along an extension line that forms an angle with respect to adjacent wedge extension lines, whereby said wedges extend from said base to provide additional stretch to the fingers and improved angular hold of the device on the hand.

3. The device of claim 1, wherein said base is formed as a substantially curved or multi-bend elongated block shape.

4. The device of claim 1, wherein a thumb depression is located on a back side of said base and opposite from where said wedges extend from said base for the purpose of receiving a thumb of the user's hand.

5. The device of claim 1, wherein a thumb depression is located on each side of said base for the purpose of receiving a thumb of a right-handed or left-handed user.

6. The device of claim 1, wherein a base ledge extends from said base for the purpose of providing a contact area for the fingers while using the device.

7. The device of claim 1, wherein a means to toughen the tips of the fingers is provided on the surface of the base where the fingers will make contact with said base, thus providing the additional benefit of toughening the tips of the fingers while using the device.

8. The device of claim 1, wherein a flexible material skin covers the surface of the device, providing an alternate textured feel, color or surface for other purposes such as, but not limited to, printing.

9. A method of simultaneously stretching a user's fingers and strengthening the user's hand and forearm comprises:

a. providing the device of claim 1, b. placing the device in the user's hand with each of the wedges placed in the spaces between the user's adjacent fingers and positioned to substantially cover and form around the adjacent finger joints, the base placed in the palm of the user's hand, the wedges and base sufficiently sized and shaped holding the position of the device securely between the fingers and on the hand of the user, c. moving the hand, wrist or arm in a user selected and user controlled manner, to simultaneously stretch the user's fingers and hand apart while strengthening the user's fingers, hand and forearm at the same time, said movements can include natural, exaggerated and dynamic motions that mimic playing of a musical instrument such as but not limited to guitar.

10. The method of claim 9, and further comprising closing, opening and holding a position of the hand as in the motion of forming and unforming a fist, said closing or semi-closing the hand will simultaneously increase the stretching force of the wedges between the fingers, and increase the resistance force of the base against the hand and fingers, said opening or semi-opening the hand will simultaneously decrease the stretching force of the wedges between the fingers, and decrease the resistance force of the base against the hand and fingers, said holding a position will produce a sustained amount of force and resistance, thus the user can control the amount, intensity and duration of force and resistance during use of the device.

11. The method of claim 9, wherein a depression is located on a back side of said base and opposite from where said wedges extend from said base for the purpose of receiving a thumb of the user's hand and further comprising placing the user's thumb in the depression during use of the device.

12. The method of claim 9, wherein a depression is located on one or more sides of said base for the purpose of receiving the thumb of the user and further comprising placing the user's thumb in said depression during use of the device.

13. The method of claim 9, wherein a base ledge extends from said base for the purpose of providing a contact area for the fingers while using the device.

14. The method of claim 9, wherein a tough or abrasive material covers the area of the base and further comprising the user's fingers making contact with the tough or abrasive surface while closing the hand in order to receive the additional benefit of toughening the tips of the fingers during use of the device.

15. The device of claim 1, wherein said base is formed as a generally spherical shape.

16. The device of claim 1, wherein said base is formed as a generally cylindrical or semi-cylindrical shape.

17. The device of claim 1, wherein said base is formed as a generally straight elongated-block shape.

18. The device of claim 1, wherein the device is produced as one unitary molded form.

* * * * *